United States Patent [19]

Kuiper

[11] 4,307,026

[45] Dec. 22, 1981

[54] PROCESS FOR THE SELECTIVE HYDROGENATION OF TRIGLYCERIDE OILS WITH A METALLIC CATALYST IN THE PRESENCE OF A DIAMINE

[75] Inventor: Jan Kuiper, Vlaardingen, Netherlands

[73] Assignee: Lever Brothers Company, New York, N.Y.

[21] Appl. No.: 159,758

[22] Filed: Jun. 16, 1980

[30] Foreign Application Priority Data

Jun. 19, 1979 [NL] Netherlands ..... 7904782

[51] Int. Cl.[3] ..... C11C 3/12

[52] U.S. Cl. ..... 260/409; 252/438

[58] Field of Search ..... 260/409; 252/438

[56] References Cited

U.S. PATENT DOCUMENTS

| | | | |
|---|---|---|---|
| 4,117,242 | 9/1978 | Fozzard | 260/409 |
| 4,161,483 | 7/1979 | Cahen | 260/409 |
| 4,228,088 | 10/1980 | Kuiper | 260/409 |

FOREIGN PATENT DOCUMENTS

| | | |
|---|---|---|
| 851202 | of 0000 | Belgium . |
| 872476 | of 0000 | Belgium . |
| 872477 | of 0000 | Belgium . |
| 402162 | of 0000 | Japan . |
| 871804 | of 0000 | United Kingdom . |

OTHER PUBLICATIONS

Izv. Akad. Nauk. USSR Ser. Khim 7 (1965), 1151–60 as abstracted in Chemical Abstracts, vol. 63 (1965) 11484.

Chemical Abstracts, vol. 59, No. 7, 30.09.1963, column 7762 c, Columbus, OH, U.S.

*Primary Examiner*—John F. Niebling

*Attorney, Agent, or Firm*—Irving N. Feit; James J. Farrell; Melvin H. Kurtz

[57] ABSTRACT

Unsaturated fatty acid derivatives which, besides fatty acids with two double bonds, contain fatty acids with more than two double bonds, are hydrogenated in the presence of a palladium, platinum or rhodium catalyst which has been treated with ethylenediamine or a homologue and/or a derivative thereof and at a temperature of −20° to 100° C. The hydrogenation progresses very selectively while very little isomerization to trans-fatty acids occurs.

For example, in the hydrogenation of soya bean oil to a linolenic acid content of 2%, the linoleic acid content only decreases to 45–52%. Under identical conditions an untreated catalyst leads to a linoleic acid content of about 35%.

19 Claims, No Drawings

PROCESS FOR THE SELECTIVE HYDROGENATION OF TRIGLYCERIDE OILS WITH A METALLIC CATALYST IN THE PRESENCE OF A DIAMINE

The invention relates to a process for the selective hydrogenation of polyunsaturated fatty acid derivatives, such as triglycerides, which, besides fatty acid with two double bonds, contain fatty acids with more than two double bonds.

As is generally known, oils and fats consist mainly of a mixture of triglycerides of fatty acids. The fatty acids usually contain about 16 to about 22 carbon atoms and may be saturated, e.g. stearic acid; mono-unsaturated, e.g. oleic acid; di-unsaturated, e.g. linoleic acid; or tri-unsaturated, e.g. linolenic acid; or may even be unsaturated to a greater degree.

In the field of technology relating to oils and fats it is usual to hydrogenate oils in order to remove the unsaturation partly, a hydrogenated oil being obtained having the desired properties, such as a higher melting point and/or increased stability.

During the hydrogenation a number of reactions take place, both successively and simultaneously. Accordingly, for example, in the hydrogenation of linolenic acid the hydrogenation reactions can be represented by the following simplified scheme:

$$\text{linolenic acid} \xrightarrow{K_1} \text{linoleic acid} \xrightarrow{K_2} \text{oleic acid} \xrightarrow{K_3} \text{stearic acid,}$$

the rate constants of the reactions being indicated with $K_1$, $K_2$, etc. Moreover, side reactions occur, such as displacement and isomerisation of double bonds. Isomerisation gives rise to the conversion of cis-double bonds into trans-double bonds, the corresponding oils which contain the trans-acids usually having a higher melting point. Oils and fats which have a high content of stearic acid have a melting point that for most applications is too high to be organoleptically acceptable. Formerly it was therefore usual to direct the hydrogenation in such a way that as little stearic acid was formed as possible, but a high content of trans-oleic acid was still obtained, so that the oil had the desired melting point. Nowadays it is considered less desirable to apply cis-trans isomerisation since there is a displacement involved to liquid, though stable oils, which are used as such or serve as components for soft margarines which are stored in the refrigerator.

The selectively values of the hydrogenation reactions are usually defined as follows:

$$S_I = K_2/K_3 \qquad S_{II} = K_1/K_2$$

When the $S_I$ value of the reaction is high, small amounts of saturated acids are obtained. With a high $S_{II}$ value it is possible to hydrogenate linolenic acid and still retain a high percentage of the essential fatty acid: linoleic acid. With the isomerisation-selectivity value, abbreviated to $S_i$, the amount of trans-isomers is indicated that is formed in relation to the degree of hydrogenation. As was already observed, it is wanted at present that hydrogenation be influenced in such a way that the $S_i$ value is as low as possible.

However, according to the current practice with hydrogenation, that is usually carried out at a high temperature and under increased pressure with the aid of a nickel catalyst supported on a carrier, significant isomerisation of double bonds cannot be avoided.

The use of some catalysts, for example copper catalysts, has been proposed on account of their higher selectivity. Although it is true that such catalysts are more selective, the degree of isomerisation they bring about is, however, about the same as that of nickel.

The use of palladium catalysts has been proposed for the selective hydrogenation of soya oil (Belgian Pat. No. 851,202). Although these catalysts are selective, the content of linoleic acid obtained with them is not higher than 40% at a linolenic acid content of 2% when a soya oil containing 7–9% of linolenic acid and 50–55% of linoleic acid is used as starting material.

According to Belgian Pat. No. 872,476 triglyceride oils are hydrogenated, using a nickel catalyst, which has been treated with a basic nitrogen compound, including hexamethylene tetramine, the molar ratio nitrogen:nickel being about 0.05–0.4:1.

According to Belgian Pat. No. 872,477 the hydrogenation of triglyceride oils is carried out, using a nickel catalyst in the presence of a basic nitrogen compound, in which the molar nitrogen:nickel ratio is about 0.05–0.4:1.

According to the last two patent specifications the hydrogenation is carried out at a temperature of 100° to 175° C. Also according to the last-mentioned two processes in the hydrogenation of soya oil to a linolenic acid content of 2%, linoleic acid contents are obtained lower than 40%, the transisomer content in the hydrogenated product being about 15 to 20%.

It has now been found, surprisingly, that very high selectivity values, particularly a high $S_{II}$ value, are obtained in the hydrogenation of poly-unsaturated fatty acid derivatives which, besides fatty acids with two double bonds, contain fatty acids with more than two double bonds, when the hydrogenation is carried out in the presence of palladium, platinum and/or rhodium as catalyst, if the catalyst is treated with ethylenediamine (1,2-diamino ethane) or a homologue and/or derivative thereof, in a molar ratio of the number of nitrogen atoms to the catalytically active metal of at least 100:1 and the hydrogenation is carried out at a temperature of −20° to 100° C.

It has already been proposed earlier to carry out the hydrogenation of edible oils in the presence of additives, such as alcohols and polyalcohols (see British Patent Specification No. 1,080,891) or amines (Japanese Pat. No. 4021/62), but with the process according to the present application higher selectivity values are obtained.

It has now been found that with the process according to the invention hydrogenation is influenced in such a way that a selective hydrogenation of polyunsaturated fatty acid groups takes place without any formation of saturated fatty acid groups at all, while relatively few trans-isomers are formed. Moreover, the invention is characterized in that linolenic acid groups (or trienoic acid groups) if present are hydrogenated more readily than dienoic acid (linoleic acid) groups, with the result that products are formed which have a low content of linolenic acid and a high content of linoleic acid.

The catalyst may contain a so-called promoter, i.e. a metal that promotes the effect of the catalyst with respect to its activity and/or selectivity, such as Cu, Ag, Zu, Zn, Sn, Ti, Zr, Hf, V, Nb, Ta, Cr, Mo, W or Mn.

The catalyst can be used in the form of a porous metal supported on a carrier in sheet form that is immersed in the system, or preferably in the form of small particles, such as palladium powder, suspended in the system. The metallic component can be supported on a carrier. Carbon, silicon dioxide, aluminium dioxide, kieselguhr or an ion-exchange resin can, for example, be used as carrier for the catalyst.

The amount of catalytically active material used for the hydrogenation is not critical and can vary from 1 mg/kg to 10 g/kg, calculated on the basis of the metal with respect to the compound to be hydrogenated, as the amount is dependent on the form of the catalyst, whether supported on a carrier or not, on the massive surface area of the catalyst, on the catalytic activity of the metal used, on the amount of diamine added, and on other factors.

The catalyst can be treated with the diamine before the hydrogenation reaction, and this mixture, either as such or after the excess diamine has been removed by decantation, can be added to the material to be hydrogenated. In the pre-treatment of the catalyst, water or an organic liquid such as acetone, tetrahydrofuran, dimethylformamide, or alcohols and polyalcohols or a mixture thereof can be used as liquid.

The diamine can also be added direct to the compound to be hydrogenated, and then preferably dissolved in one of the above-mentioned solvents. When this method is followed, the treatment of the catalyst with the diamine takes place in situ.

The amount of diamine is such that at least 100 nitrogen atoms per atom of the catalytically active metal are present. As a result of this a high selectivity of the hydrogenation is ensured. For example, in the hydrogenation of soya oil which contains about 55% of linoleic acid and 7% of linolenic acid, the amount of linolenic acid can be reduced to 2%, the linoleic acid content remaining higher than 40%, i.e. at least 70% of the original linoleic acid is retained. Often even more than 80% and even more than 90% of the linoleic acid is retained. The activity, the selectivity and the formation of trans-isomers depend on the amount of diamine that is added. If this amount is increased, this usually leads to lower activity and to a better selectivity and less cis-trans isomerisation.

The ratio of the number of nitrogen atoms to the catalytically active metal is generally not higher than 5,000:1, preferably 2,000:1.

The activity, selectivity and the formation of trans-isomers effected during hydrogenation with the addition of a certain amount of diamine are dependent on the amount and the type of catalyst. When a triglyceride is hydrogenated, the quality of the oil and the refining process of the raw oil influence the hydrogenation characteristics when different amounts of diamines are added.

Besides ethylenediamine itself, also homologues and/or derivatives thereof can be used. Examples of such homologues and derivatives are: diethylenediamine (piperazine or perhydro-1,4-diazine), triethylenediamine (1,4-diazabicyclo[2.2.2]octane), diethylenetriamine (1,4,7-triazaheptane), hexamethylenetetramine and suchlike; 1,2-diaminopropane, 1,3-diaminopropane, and suchlike. Compounds of primary, secondary or tertiary amino groups also yield excellent results.

Examples of such compounds are: N,N,N',N'-tetramethylethylenediamine, N,N,N',N'-tetramethylhexanediamine, N,N,N',N'-tetramethyldiethylenetriamine, N,N-dimethyl-1,3-propanediamine, etc. Oligoamines or polyamines, such as 4,7,11-triazatetradecane-1,14-diamine, can also be used.

When the process according to the invention is being carried out, the compound to be hydrogenated can be dissolved or dispersed in an organic liquid such as a ketone or a hydrocarbon. Good results are also obtained with alcohols, though in that case alcoholysis or interesterification can occur; so, if alcoholysis or interesterification is desired, alcohols can then be used.

The ratio of liquid to substrate is not critical and can vary from an amount that is just necessary to dissolve the diamine and to keep the catalyst in suspension up to about 20:1.

The hydrogenation can also be carried out in the pure compound, while the added diamine is dissolved in water or an organic liquid.

The process is not sensitive to the presence of water, although the amount of water should be limited to a minimum, so that as little loss of oil as possible takes place because of saponification of the ester or that separation of the catalyst/substrate mixture occurs.

Generally the hydrogenation is carried out in a suitable apparatus, such as a reaction vessel with a stirrer, or continuously in a series of reaction vessels with stirrer, though good results can also be obtained when the hydrogenation takes place over a column of catalyst particles. The hydrogenation can be carried out by adding the diamine and the catalyst to the substrate under nitrogen or another inert gas and starting the hydrogenation reaction by addition of hydrogen, or the substrate can be introduced into the reaction vessel in which the diamine or a pretreated catalyst is present under a hydrogen atmosphere. The catalyst can first be treated with the diamine and added to the hydrogenation reactor, or the excess diamine can be removed by centrifuging or filtering and washing, whereafter the treated catalyst is introduced into the hydrogenation reactor in which the substrate to be hydrogenated is present.

The temperature at which the hydrogenation is carried out is preferably 0° C. to 60° C.

The reaction can be carried out under atmospheric pressure or under higher pressure; generally the pressure will vary from 100 to 2500 kPa. Naturally, if it is desired to work at a temperature above the boiling point of any liquid used, a pressure above atmospheric pressure should be applied.

The process can be regulated in a known manner, for example by stopping the hydrogenation when a previously calculated amount of hydrogen has been absorbed.

The process according to the invention can be applied for the hydrogenation of compounds or groups which contain more than one double bond in order to increase the selectivity of the hydrogenation reaction. Examples that can be mentioned are the hydrogenation of soya oil, rapeseed oil, linseed oil, fish oils, tallow and similar animal fats, esters of fatty acids, such as the methyl-, ethyl- and other alkylesters, soaps, alcohols and other fatty acid derivatives in which the hydrogenation plays an important role.

The products can be used as deep-frying oil, table oil, as raw material for margarine or as raw material for the preparation of stable products such as soaps, esters, etc.

The invention is further illustrated by means of the following Examples. In some Examples the sum of the amounts of components does not add up to 100%, as less important fatty acid components, such as $C_{14}$-, $C_{17}$-, $C_{20}$- and $C_{22}$-fatty acid, are not mentioned. The composition of the substrates before and after hydrogenation is given in mol.%.

In the Tables the fatty acids are designated by the number of carbon atoms present therein and the number of double bonds, that is to say C18:3 means linoleic acid and isomers, C18:2 means linoleic acid and isomers, etc.

EXAMPLE I

The hydrogenation was carried out under atmospheric pressure and at room temperature in an apparatus consisting of a vessel with a net volume of 100 $cm^3$ and provided with a magnetic stirrer, four baffle plates, an inlet for hydrogen, an inlet for substrate and a device for drawing off samples.

The reactor was connected with a 500 $cm^3$ calibrated burette filled with hydrogen (purified over a copper catalyst (BTS) and a molecular sieve) and paraffin oil. The reactor was loaded with 60 mg palladium on carbon (3%) as catalyst and 70 ml acetone. The reactor was repeatedly evacuated and purged with argon. The solution was stirred and 1 ml ethylenediamine added. Subsequently the argon was replaced by hydrogen. After 15 minutes 25 g oxygen-free soya oil was added.

At fixed intervals samples were drawn off for determination of the fatty acid composition by GLC and the trans content by IR, as is shown in Table A.

TABLE A

| Hydrogenation time (min.) | Fatty acid composition (mol. %) | | | | | Trans (%) |
|---|---|---|---|---|---|---|
| | C16:0 | C18:0 | C18:1 | C18:2 | C18:3 | |
| Starting oil | 10.8 | 3.9 | 23.4 | 54.7 | 7.2 | — |
| 70 | 10.8 | 3.6 | 31.6 | 51.3 | 2.6 | 6 |
| 110 | 10.8 | 3.6 | 35.6 | 48.3 | 1.6 | 7 |
| 155 | 10.8 | 3.8 | 41.0 | 43.8 | 0.7 | 8 |

In a comparative test in which no diamine was present but otherwise under the same conditions, the following result was obtained:

| Hydrogenation time (min.) | Fatty acid composition (mol. %) | | | | | Trans (%) |
|---|---|---|---|---|---|---|
| | C16:0 | C18:0 | C18:1 | C18:2 | C18:3 | |
| 8 | 10.7 | 5.0 | 46.5 | 35.5 | 2.0 | 12 |

EXAMPLE II

Example I was repeated, with the exception that other additives, such as indicated in Table B, were used. The fatty acid composition at 2% C18:3 was determined by interpolation.

TABLE B

Selective hydrogenation of soya oil with palladium-on-carbon catalyst (3%) in a medium consisting of acetone with various organic nitrogen compounds as additive. Conditions: 60 mg Pd/C (3%), 70 ml acetone, 25 g soya oil.

| Additive | mmol | Fatty acid composition (mol. %) | | | | | Trans (%) | Reaction time (min.) |
|---|---|---|---|---|---|---|---|---|
| | | C16:0 | C18:0 | C18:1 | C18:2 | C18:3 | | |
| Starting oil | — | 10.8 | 3.9 | 23.4 | 54.7 | 7.2 | | |
| Ethylenediamine | 15 | 11.0 | 3.6 | 33.5 | 49.5 | 2.0 | 6 | 90 |
| Diethylenediamine (piperazine) | 2 | 11.0 | 3.7 | 34.0 | 49.5 | 2.0 | 6 | 43 |
| Triethylenediamine | 2 | 11.0 | 3.7 | 35.0 | 48.0 | 2.0 | 6 | 28 |
| Diethylenetriamine | 1 | 10.6 | 4.0 | 37.0 | 46.2 | 2.0 | 7 | 45 |
| N,N,N',N'-tetramethylenediamine | 6 | 11.0 | 4.0 | 37.0 | 46.0 | 2.0 | 7 | 25 |
| N,N,N',N'-tetramethylhexanediamine | 2 | 11.0 | 4.0 | 37.3 | 45.3 | 2.0 | 7 | 27 |
| Hexamethylenetetramine | 2 | 10.8 | 3.8 | 37.7 | 45.8 | 2.0 | 7 | 20 |
| 1,2-diaminopropane | 6 | 11.0 | 4.0 | 35.0 | 47.0 | 2.0 | 6 | 31 |
| 1,3-diaminopropane | 10 | 11.0 | 3.6 | 33.5 | 49.0 | 2.0 | 5 | 80 |
| N,N-dimethyl-1,3-propanediamine | 7 | 10.8 | 4.0 | 36.0 | 47.0 | 2.0 | 7 | 33 |

EXAMPLE III

Example I was repeated, with the exception that another solvent was used, as indicated in Table C.

TABLE C

| Solvent | Additive (mmol) | Fatty acid composition (mol.%) | | | | | Trans (%) | Reaction time (min.) |
|---|---|---|---|---|---|---|---|---|
| | | C16:0 | C18:0 | C18:1 | C18:2 | C18:3 | | |
| Ethyl-acetate | Piper-azine (1) | 10.8 | 3.6 | 35.0 | 49.5 | 2.0 | 6 | 80 |

EXAMPLE IV

The reaction was carried out in a reaction vessel with thermostat, and with the same provisions as according to Table A. The reactor was loaded with 200 mg palladium on carbon (3%) and 35 g soya oil. The temperature was adjusted to 40° C. and the stirring was started. The reactor was repeatedly evacuated and purged with argon. Subsequently 0.05 $cm^3$ ethylenediamine was added. The argon was replaced by hydrogen and the hydrogenation was started. The results are shown in Table D.

TABLE D

| Hydrogenation time (min.) | Fatty acid composition (mol. %) | | | | | Trans (%) |
|---|---|---|---|---|---|---|
| | C16:0 | C18:0 | C18:1 | C18:2 | C18:3 | |
| Starting oil | | | | | | |
| 80 | 10.7 | 3.7 | 30.4 | 52.7 | 2.4 | 7 |
| 120 | 10.8 | 3.6 | 34.2 | 50.2 | 1.3 | 10 |

I claim:

1. A process for hydrogenating polyunsaturated fatty acids comprising:

treating a metal selected from the group consisting of paladium, platinum, rhodium and mixtures thereof with ethylenediamine or a homolog or derivative thereof at a molar ratio of nitrogen atoms to said metal of between 100:1 and 5000:1; and contacting said polyunsaturated fatty acids with a catalytically effective amount of said metal at a temperature of −20° to 100° C.;

wherein said process is capable of producing a yield of linoleic acid higher than about 40% and a yield of trans isomers less than about 10% when soya oil containing about 55% linoleic acid and 7% linoleic acid is hydrogenated to a yield of linolenic acid of less than 2%.

2. Process according to claim 1, in which the catalyst is treated with the diamine before it is added to the fatty acid derivative to be hydrogenated.

3. Process according to claim 2, in which the excess diamine is separated from the catalyst before said catalyst is added to the fatty acid derivative to be hydrogenated.

4. Process according to claim 1, in which the diamine is added direct to the fatty acid derivative to be hydrogenated.

5. Process according to claim 1, in which a solution of the diamine in water or an organic solvent is used.

6. Process according to claim 1, in which diethylene diamine is used.

7. Process according to claim 1, in which triethylene diamine is used.

8. Process according to claim 1, in which diethylenetriamine is used.

9. Process according to claim 1, in which N,N,N′,N′-tetramethyl ethylenediamine is used.

10. Process according to claim 1, in which N,N,N′,N′-tetramethylhexane diamine is used.

11. Process according to claim 1, in which hexamethylene tetramine is used.

12. Process according to claim 1, in which 1,2-diaminopropane is used.

13. Process according to claim 1, in which 1,3-diaminopropane is used.

14. Process according to claim 1, in which N,N-dimethyl-1,3-diaminopropane is used.

15. Process according to claim 1, in which the hydrogenation is carried out while the fatty acid derivative is in solution in an organic solvent, such as a ketone, a hydrocarbon or an alcohol or a mixture thereof.

16. Process according to claim 1, in which the hydrogenation is carried out at a temperature of between 0° and 60° C.

17. Process according to claim 1, in which the hydrogenation is carried out under a pressure of between 100 and 2500 kPa.

18. Process according to claim 1, in which the fatty acid derivative is an edible triglyceride oil.

19. The process of claim 1 wherein said process consists essentially of contacting said unsaturated fatty acid derivatives with said metals.

* * * * *

UNITED STATES PATENT AND TRADEMARK OFFICE

CERTIFICATE OF CORRECTION

PATENT NO. : 4,307,026

DATED : December 22, 1981

INVENTOR(S) : Jan Kuiper

It is certified that error appears in the above-identified patent and that said Letters Patent are hereby corrected as shown below:

Claim 1, column 7, line 11: "7% linoleic acid" should read -- 7% linolenic acid --.

Signed and Sealed this

*Second* Day of *August 1983*

[SEAL]

*Attest:*

GERALD J. MOSSINGHOFF

*Attesting Officer*

*Commissioner of Patents and Trademarks*